US005626416A

United States Patent [19]

Romano et al.

[11] Patent Number: 5,626,416

[45] Date of Patent: May 6, 1997

[54] LAMP MODULE APPARATUS

[76] Inventors: Richard J. Romano, 2478 Peacock La., Corona, Calif. 91720; Robert A. Fry, 22265 Tiburon St., Laguna Hills, Calif. 92653

[21] Appl. No.: 350,094

[22] Filed: Nov. 29, 1994

[51] Int. Cl.[6] ..... F21V 29/00

[52] U.S. Cl. ..... 362/264; 362/294; 362/96; 362/285

[58] Field of Search ..... 362/264, 294, 362/373, 345, 96, 285, 418

[56] References Cited

U.S. PATENT DOCUMENTS

| | | | |
|---|---|---|---|
| 3,758,769 | 9/1973 | Pichel | 362/264 |
| 4,302,801 | 11/1981 | Duddy | 362/294 |
| 4,630,182 | 12/1986 | Moroi et al. | 362/345 |
| 4,675,794 | 6/1987 | Fink, Jr. et al. | 362/285 |
| 4,890,208 | 12/1989 | Izenour | 362/294 |
| 4,935,853 | 6/1990 | Collins | 362/294 |
| 5,138,541 | 8/1992 | Kano | 362/294 |
| 5,369,557 | 11/1994 | Ronney | 362/285 |

OTHER PUBLICATIONS

Advertisement for Martin Roboscan Pro, (no date).
Advertisement for Coemar Nat. (no date).
Advertisement for High End Cyberlight, (no date).

*Primary Examiner*—Denise L. Gromada
*Assistant Examiner*—Sara Sachie Raab
*Attorney, Agent, or Firm*—Ashen Golant Lippman

[57] ABSTRACT

A lamp module apparatus which may be used with theatrical lighting fixture, the module including a lamp, an elliptical reflector, a secondary spherical reflector, a heatsink, a forced air system, adjustment clamps and a mirror. The module may be removed from a fixture and easily reinstalled allowing for added safety for the lamp and a more efficient fixture system. The lamp is adjustable relative to the module so that lamp modules may be interchangeable.

5 Claims, 4 Drawing Sheets

LAMP MODULE APPARATUS

BACKGROUND OF THE INVENTION

1. Field of the Invention

The present invention relates to a lamp module apparatus, and more particularly to a lamp module apparatus for use with a theatrical lighting fixture which is more efficient, easier to transport and brighter.

2. Description of the Related Art

There are many existing theatrical lighting devices such as the Martin Roboscan Pro, the Coemar Nat and the High End Cyber-light. While these lights may represent the state-of-the-art there is a continuing need for greater brightness, lower weight, increased reliability, facilitated transport and easy alignment.

Existing theatrical lighting fixtures constantly battle the tradeoff between more powerful lamps and the tremendous heat which must be handled. Existing lamps also require heavy ballast which runs counter to the need for low weight to facilitate handling and transport. There is even a problem achieving consistent color from existing lamps of the same brand and power.

Hence, the numerous prior attempts to provide superior theatrical lighting has yet to produce an optimal system.

BRIEF DESCRIPTION OF THE INVENTION

The difficulties encountered by the previous theatrical lighting systems have been overcome by the present invention. What is described here is a lamp module apparatus comprising a casing; a xenon lamp connected to the casing; and a elliptically shaped dichroic reflector connected to the casing and disposed about the lamp. Also included is a second spherically shaped dichroic reflector also disposed about the lamp, a heatsink, a mirror and an air path having two branches to help cool the apparatus.

An object of the present invention is to provide a brighter, lighter, more easily transportable lamp module which may be used with a theatrical lighting fixture.

Another feature of the present invention is to provide a lamp module with a superior cooling system, a superior alignment system and yet be interchangeable with other lamp modules.

A more complete understanding of the present invention and other objects, features and advantages thereof will be gained from a consideration of the following description of the preferred embodiment read in conjunction with the accompanying drawings provided herein.

DESCRIPTION OF THE PREFERRED EMBODIMENT

Figure 1:
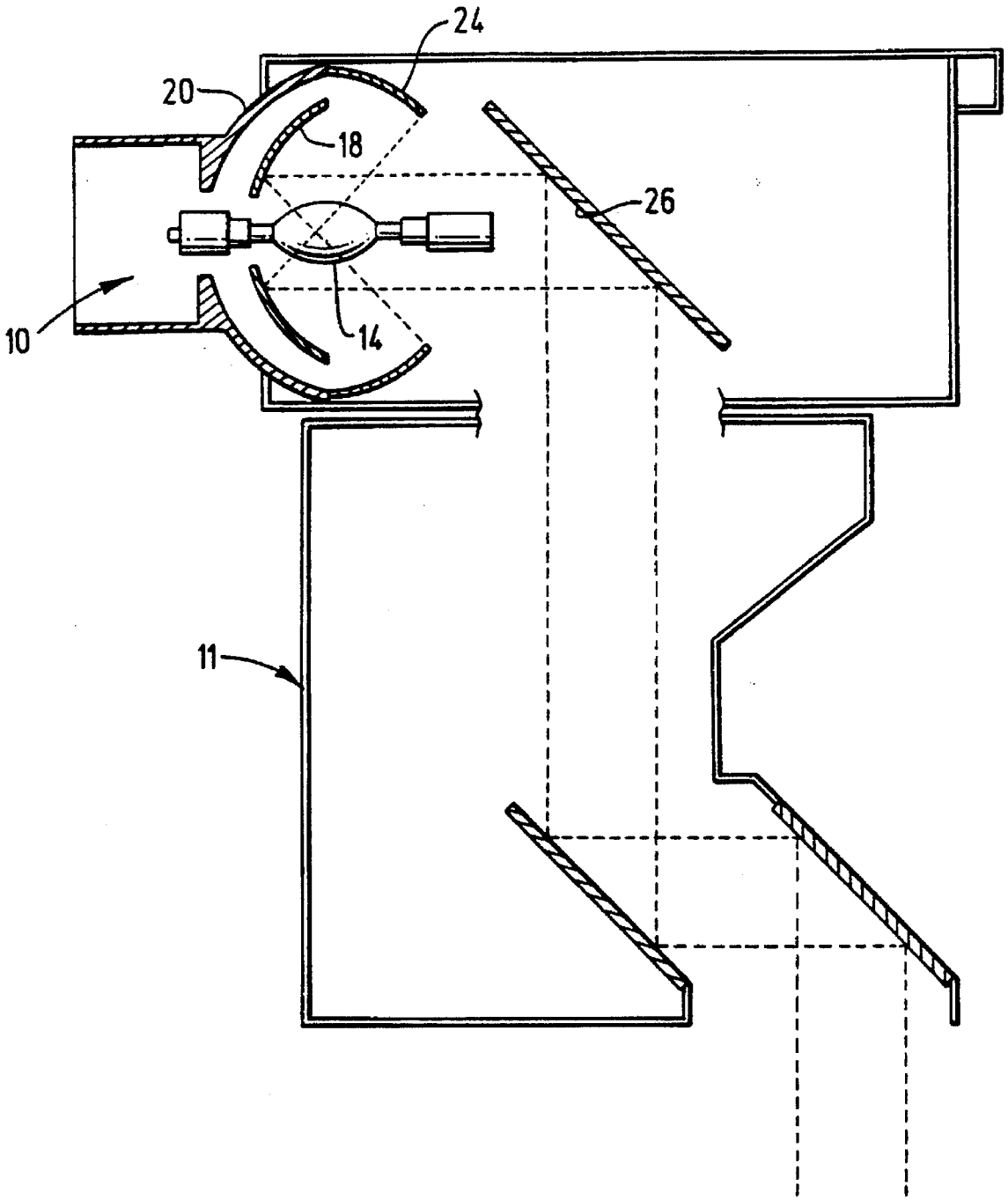
FIG. 1 is a diagrammatic, side elevational, partially broken away, partially sectional view of a lighting fixture showing the location of the lamp module apparatus of the present invention.

While the present invention is open to various modifications and alternative constructions, the preferred embodiment shown in the drawings will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

The modular design of the present invention which makes it easy to slide a lamp, reflectors and mirror in and out of a lighting fixture may be seen by reference to FIG. 1 which illustrates the lamp module apparatus 10 as part of a lighting fixture 11. The lamp module 10 is intended to be stationary while the remainder of the lighting fixture 11 may rotate. This configuration has several advantages which will be discussed hereinbelow.

Referring now to FIGS. 2–5, the lamp module is described in detail. The lamp includes an outer casing 12 which is generally box-like and which houses the other elements of the lamp module. Within the housing is a light source or lamp 14 such as a xenon lamp that is in threaded engagement with a stud 16 and positioned in an axial direction. The xenon lamp may have a 2000 watt rating. The opposite end of the lamp 14 is supported by a three legged clamp 17.

Positioned about the bulb is an elliptical reflector 18. The elliptical reflector is made of a "cold mirror" dichroic to allow infrared energy in the nature of heat to pass through the reflector while the usable visible energy is reflected. A typical dichroic material is glass coated with a dielectric film. Positioned about the elliptical reflector is a heatsink 20. The heatsink is attached to the casing 12 and performs the function of drawing heat away from the lamp. The heatsink may have a spherical shape and may be made of aluminum.

Connected to the rim 22 of the heatsink is a second reflector 24 having a spherical shape. The spherical reflector reflects light rays into the optical system that ordinarily would be lost. The reflector 24 is also made of "cold mirror" material which reflects only the visible light but allows the infrared energy to be passed out of the optical path. Since most lamp systems do not use a secondary reflector to "reclaim" light that would ordinarily be lost, the two reflector system shown here, with the elliptical reflector 18 and the spherical reflector 24, makes the present invention a much more efficient device.

Downstream of the reflectors and the lamp is a mirror 26 connected to the casing at a 45 degree angle to the optical axis. The mirror causes the optical axis to turn a 90 degree angle as shown in FIG. 1 and be directed downwardly. Downstream of the mirror in a theatrical lighting fixture may be a color changer, a gobo system, and a lens system.

It is apparent that the lamp 14 is mounted perpendicular to the optical axis that is downstream of the 90 degree turn and this is done for two reasons. First, there is a greater distance along the optical path. The second advantage is the lamp burn angle. Burn angle is important because xenon lamps must burn at a specific attitude to maintain brightness and long life. Here, the lamp has a horizontal burn angle. Mounting the lamp in the casing as shown allows the lighting fixture to be disposed in any position while the lamp maintains a consistent burn angle.

A cooling system is provided for the lamp module and comprises a fan 30 which blows air along the path illustrated by the phantom line 32. The line 32 is symbolic for the "tube" of air that flows around the stud 16 and the lamp 14. As the tube of air approaches the elliptical reflector it splits into two branches, outer branch 34 which flows between the elliptical reflector 18 and the heatsink 20 and inner branch 36 which flows between the elliptical reflector and the lamp 14. These two branches come together in the region generally designated 38 by the phantom circle but which generally forms a torus. The forced air flow helps cool the heatsink, the elliptical reflector, the spherical reflector and the lamp. The air is then reflected by the mirror and flows along the optical path.

It is very important to have a system that is relatively cool. This is achieved by the forced air flow and also the cold mirror design for the elliptical and spherical reflectors. Using cold mirror reflectors is important because it dramatically reduces the heat in the optical system thereby allowing the other elements of a fixture such as the gobo, the color changer and the lens to operate at significantly cooler temperatures. Existing lighting fixtures are significantly more expensive in order to deal with the excessive heat or they have decreased performance by going to a smaller light source. A smaller source may reduce the amount of heat, but it also reduces the usable light.

Figure 2:
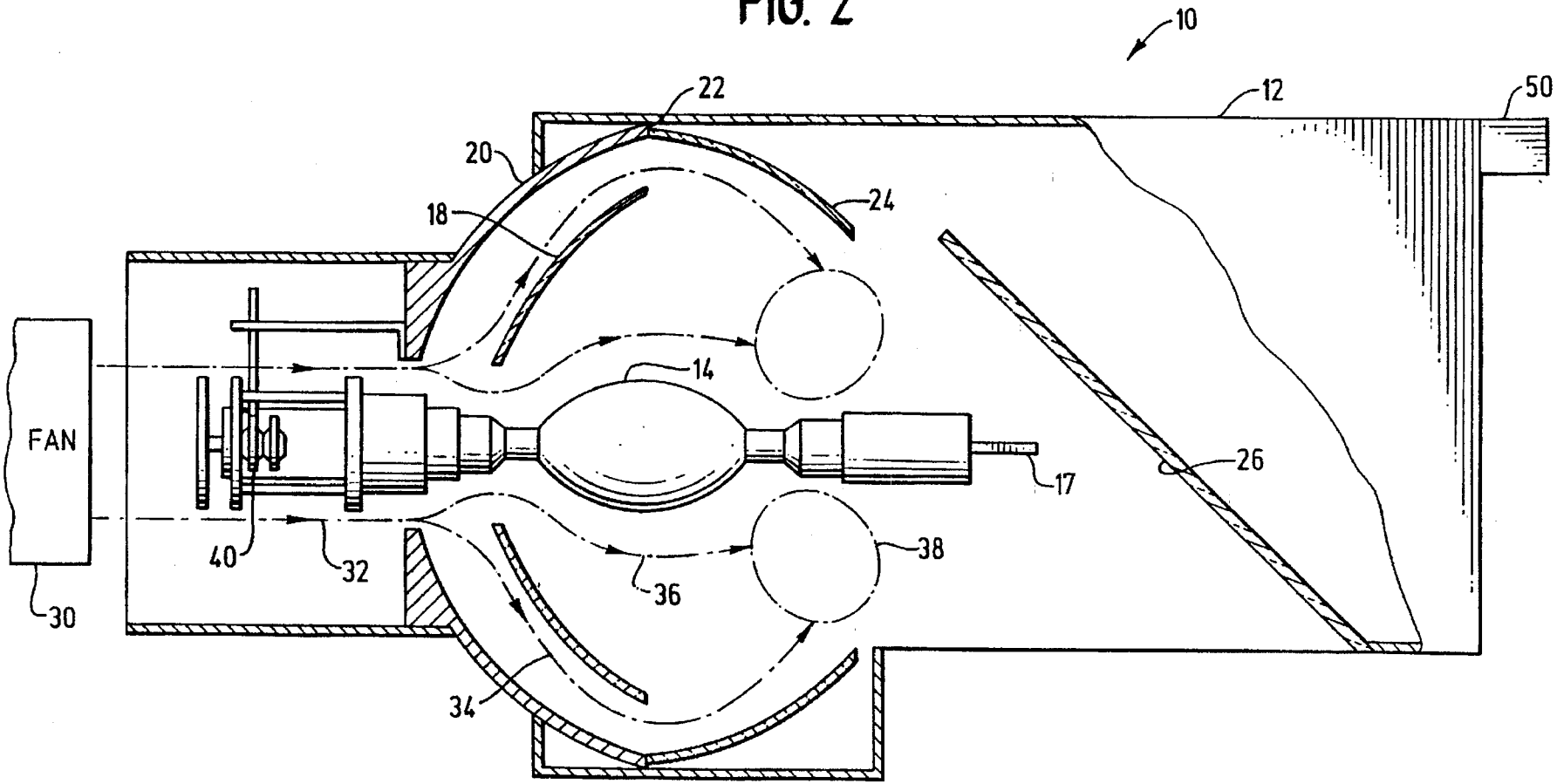
FIG. 2 is a diagrammatic, side elevational, partially broken away, partially sectional view of the present invention.
Figure 3:
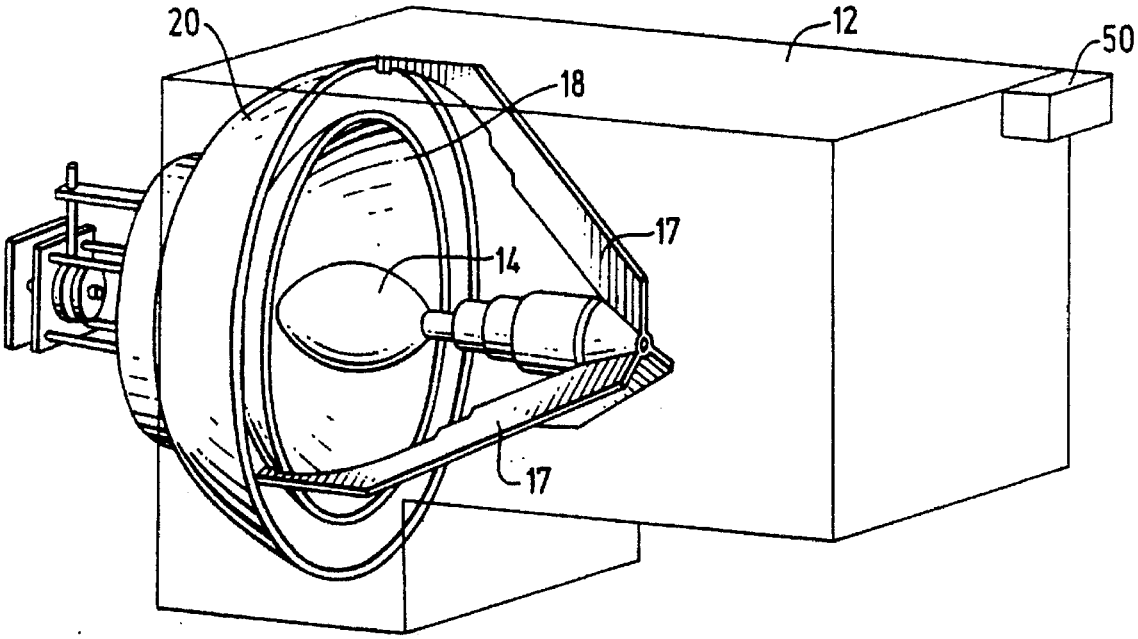
FIG. 3 is a partial diagrammatic perspective view of a portion of the lamp module apparatus with its casing shown as transparent.
Figure 4:
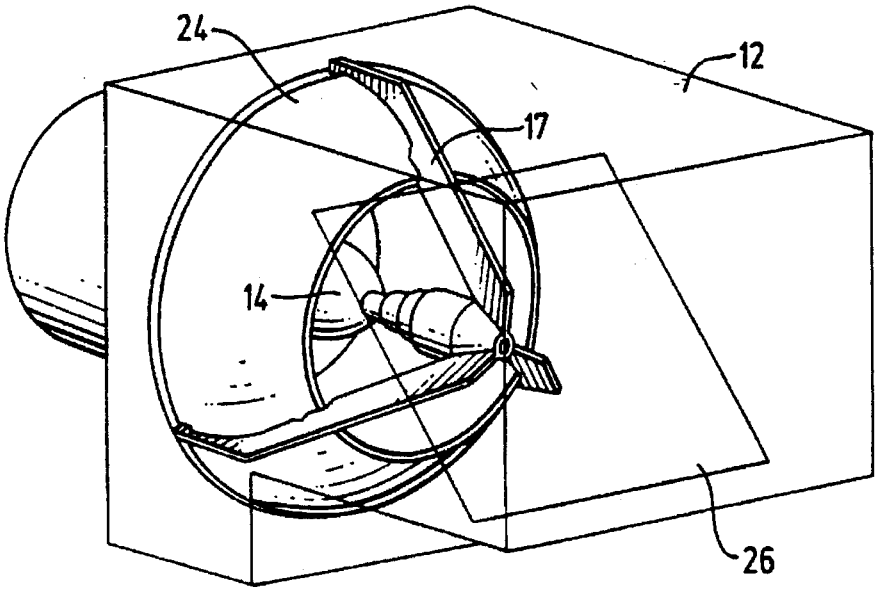
FIG. 4 is another diagrammatic perspective view of the lamp module apparatus with its casing shown as transparent.
Figure 5:
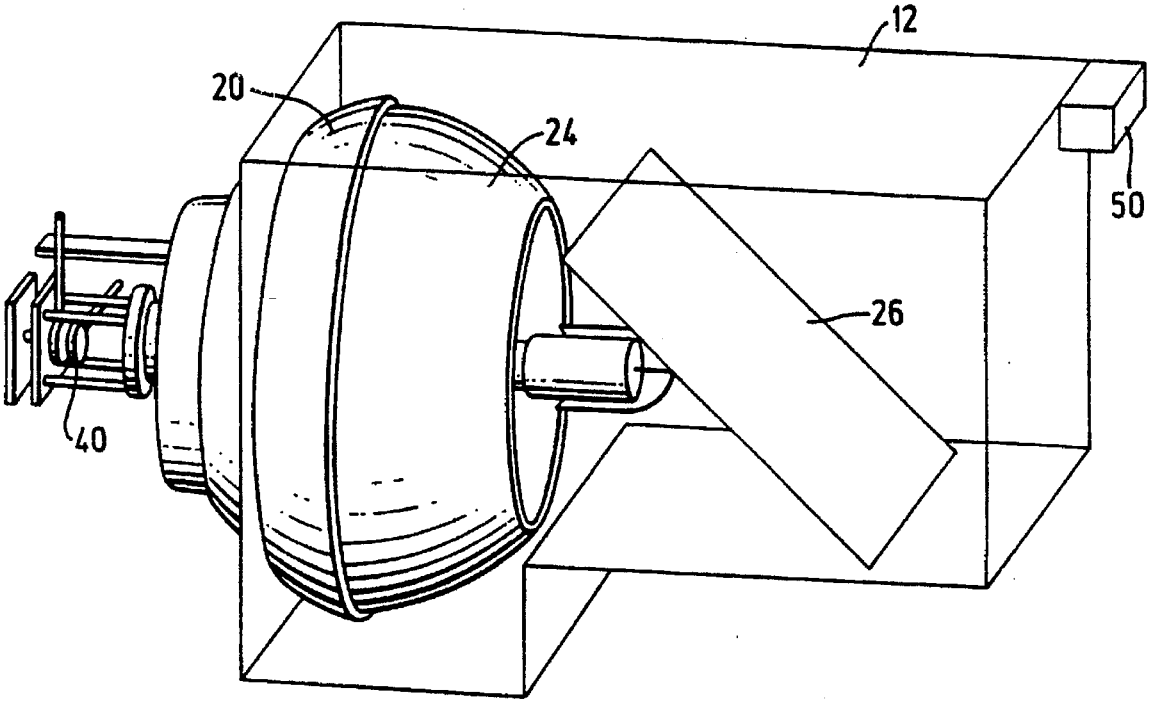
FIG. 5 is a still different diagrammatic perspective view of the present invention with its casing shown as transparent.

At the upstream portion of the casing, to the left of the stud 16 when viewed in FIG. 2, adjustment clamps in the form of a ball joint 40, are provided to allow orientation of the lamp in the X, Y and Z axes. With the adjustment clamps located within the casing, the lamp 14 may be aligned while it is outside the lighting fixture. This allows the lamp to be removed from the fixture and then reinstalled easily and quickly. There is no longer a need for the time consuming step of realignment of the lamp every time it is reinstalled. Hence, the lamp may be removed for transport and reinstalled with a minimum of effort.

At the opposite end of the casing 12 is a power connector 50 which allows the lamp module to be connected to the rest of the lighting fixture and to controlling software. This is a safety feature in the system because if the lamp is to be replaced, for example, the module must be removed from the fixture. When this happens, power is disconnected. Accidents are thus avoided.

A ballast is attached to the fixture so as to make the lamp module self contained. The module contains the elliptical and spherical reflectors 18, 24, the lamp 14, the mirror 26, the heatsink 20 and the adjustment clamps 40. There are three distinct advantages obtained by using a module system. First is the ease of removal. Most theatrical xenon fixtures require complex and time consuming procedures to remove a lamp. The lamp module 10 allows an operator to easily pull the casing completely out of the fixture so as to allow quick and easy access to the lamp. The second advantage is the lamp alignment. As mentioned, X, Y and Z axes alignment is done relative to the casing. This allows the lamp to be aligned while it is out of the fixture. Since the lamp is aligned relative to the casing, and the casing is aligned relative to the optical axis, all lamp modules are optically consistent so that any module will work in any fixture. The third advantage is that the module 10 is easily shipped. Xenon lamps are volatile and fragile and are not usually shipped inside a fixture. With the module 10 the lamp may be easily and quickly removed for shipping and then reinstalled without the need for alignment. This makes the system less expensive, more reliable and easier to handle.

The location of the power connector 50 allows all electrical connections to be made easily. In other zenon fixtures, if the lamp is removed for shipment, all electrical connections must be undone and then reinstalled. In the present invention, all lamp electrical connections are made relative to the connector on the module casing allowing the module to be removed without undoing any lamp wiring connections. This allows the electrical connection to the ballast to be made or broken automatically upon installing or removing the lamp module.

In operation, the lamp module 10 is a self contained unit including the light source, the reflectors, the heatsink, the air path system and the mirror in a compact and a relatively lightweight package. This "package" may be removed easily from a lighting fixture to facilitate traveling, lamp replacement, and alignment, for example, and yet it may be easily reinstalled by simply sliding it into a fixture.

What is claimed is:

1. A lamp module apparatus comprising:

a casing;

a xenon lamp connecting to said casing;

an elliptically shaped dichroic reflector connected to said casing and disposed about said lamp; and a spherically shaped secondary dichroic reflector connected to said casing disposed about said lamp and adjacent said elliptically shaped reflector.

2. An apparatus as claimed in claim 1 including:

a heatsink connected to said casing and to said spherically shaped reflector and disposed about said lamp.

3. An apparatus as claimed in claim 2 including:

a mirror connected to said casing and spaced from said reflectors adapted to receive light generated by said lamp.

4. An apparatus as claimed in claim 3 including:

an air path having two branches, one between the heatsink and the elliptical reflector and the other between the elliptical reflector and the lamp; and a region where said two branches come together.

5. An apparatus as claimed in claim 4 including:

Means connected to said casing and said lamp for aligning said lamp relative to said reflectors.

* * * * *